US006263184B1

(12) United States Patent
Diederiks, Jr.

(10) Patent No.: US 6,263,184 B1
(45) Date of Patent: Jul. 17, 2001

(54) SYSTEM FOR PREVIEWING THE ALIGNMENT OF A DOCUMENT POSITIONED IN A COPIER MACHINE

(76) Inventor: Everett G. Diederiks, Jr., 12804 Valleyhill St., Woodbridge, VA (US) 22192

( * ) Notice: Subject to any disclaimer, the term of this patent is extended or adjusted under 35 U.S.C. 154(b) by 0 days.

(21) Appl. No.: 09/545,348

(22) Filed: Apr. 7, 2000

Related U.S. Application Data

(60) Provisional application No. 60/128,282, filed on Apr. 8, 1999.

(51) Int. Cl.[7] ..... G03G 15/00

(52) U.S. Cl. ..... 399/377; 399/380

(58) Field of Search ..... 399/377, 379, 399/380, 365; 355/75

(56) References Cited

U.S. PATENT DOCUMENTS

| | | | |
|---|---|---|---|
| 3,697,176 | 10/1972 | Kuehnle et al. . | |
| 4,174,175 | 11/1979 | DiMaria . | |
| 4,436,402 | 3/1984 | Seimiya et al. . | |
| 4,711,560 | 12/1987 | Hosaka et al. . | |
| 4,870,458 * | 9/1989 | Shibuya et al. | 399/185 |
| 4,905,045 * | 2/1990 | Sasaki et al. | 399/14 |
| 4,978,996 * | 12/1990 | Akamatsu | 399/189 |
| 5,172,178 | 12/1992 | Oushiden et al. . | |
| 5,710,967 | 1/1998 | Motoyama . | |

FOREIGN PATENT DOCUMENTS

| | | |
|---|---|---|
| 61-095333 * | 5/1986 | (JP) . |
| 5-257207 * | 10/1993 | (JP) . |
| 8-278574 * | 10/1996 | (JP) . |
| 10-126580 * | 5/1998 | (JP) . |

* cited by examiner

*Primary Examiner*—Robert Beatty

(57) ABSTRACT

A copy machine is provided with a supplemental illumination source preferably fixedly mounted beneath a transparent copying plate upon which a document to be copied is placed. The illumination source can be selectively activated to allow light to pass through the document such that subject matter on the document can be viewed prior to performing a copying operation. By viewing the subject matter, the portion of the document to be actually copied can be adjusted and aligned in a desired manner such that only the desired portions of the subject matter on the document can be copied. Provisions are made for assuring that the illumination source will be de-activated during the copying operation.

15 Claims, 1 Drawing Sheet

12
14
18
49
29
15
26
38
2
20
34
31
41
17
28
24
10
22
8
42
4
6

12
49
46
2
14
29
44
20
26
15
34
10
31
38
28
8
41
17
6
4
22

SYSTEM FOR PREVIEWING THE ALIGNMENT OF A DOCUMENT POSITIONED IN A COPIER MACHINE

This application claims benefit of provisional application 60/128,282 filed Apr. 8, 1999.

BACKGROUND OF THE INVENTION

1. Field of the Invention

The present invention pertains to the art of copier machines and, more particularly, to a system for aiding a user of a copy machine to preview the arrangement of a document within a paper copying area, as well as a method of utilizing such a document previewing system.

2. Discussion of the Prior Art

In copying a piece of paper or other type of document, it is often desirable to limit the area of the document which is to be copied. In other words, it is often desirable to only copy a portion of a document or to simultaneously copy only portions of multiple documents. Unfortunately, properly positioning one or more documents within a copy zone of the machine can be extremely difficult. Typically, the document(s) will have to be initially copied to determine if any unwanted portions thereof are improperly positioned. Numerous iterations of this process may be required in order to simply obtain the proper document arrangement for copying. Obviously, this procedure wastes not only copy paper, but toner and operator time.

In an effort to address this problem in the art, it has been proposed to modify the construction of a copier machine to incorporate a display device which would enable any documents placed in the copy area to be viewed prior to actually performing the copying operation. An example of such a proposed prior art solution is presented in U.S. Pat. No. 4,174,175. In general, the type of display arrangement presented in this patent is similar to that utilized in connection with the previewing of microfilm prior to copying. Although this proposed arrangement does enable a copy machine operator to preview the document(s) prior to any copies being made, the overall display system considerably changes the construction of a standard copier machine and therefore represents a significant increase in the overall manufacturing costs of machines incorporating this technology. For at least this reason, this document preview system is not practical for incorporation in at least the majority of copier machines, particularly smaller copier machines used by numerous businesses.

Based on the above, there exists a need in the art for a system used in previewing documents to be copied, wherein the system is inexpensive and can be readily incorporated into existing copy machine designs, as well as being extremely effective and easy to operate.

SUMMARY OF THE INVENTION

The present invention is directed to the incorporation of a document previewing system in a conventional copy machine. More specifically, a copy machine is provided with a supplemental illumination source, such as an incandescent, a fluorescent or an optical lighting unit, beneath a transparent copying plate upon which a document to be copied is placed. With this arrangement, the illumination source can be selectively activated to allow the light to pass through the document such that subject matter on the document can be viewed, albeit a mirror image of the actual document subject matter. By simply viewing the writings, the document can be easily adjusted upon the copying plate in order to select the desired portions of the written material to be copied.

In accordance with a preferred embodiment of the invention, the illumination source is selectively controlled through the use of a switch arranged on a control panel portion of the copy machine. In the most preferred form, power to the illumination source also goes through an additional switch which is associated with the cover for the copying plate. With this arrangement, the previewing light source can only be turned on when the cover is opened and the control panel switch is activated. In addition, the previewing light source is automatically turned off whenever the cover is lowered to assure that the previewing light source will be maintained in an off condition whenever a copying operation is to be performed.

Additional objects, features and advantages of the present invention will become more readily apparent from the following detailed description of a preferred embodiment thereof when taken in conjunction with the drawings wherein like reference numerals refer to corresponding parts in the several views

DETAILED DESCRIPTION OF THE PREFERRED EMBODIMENT

Figure 1:
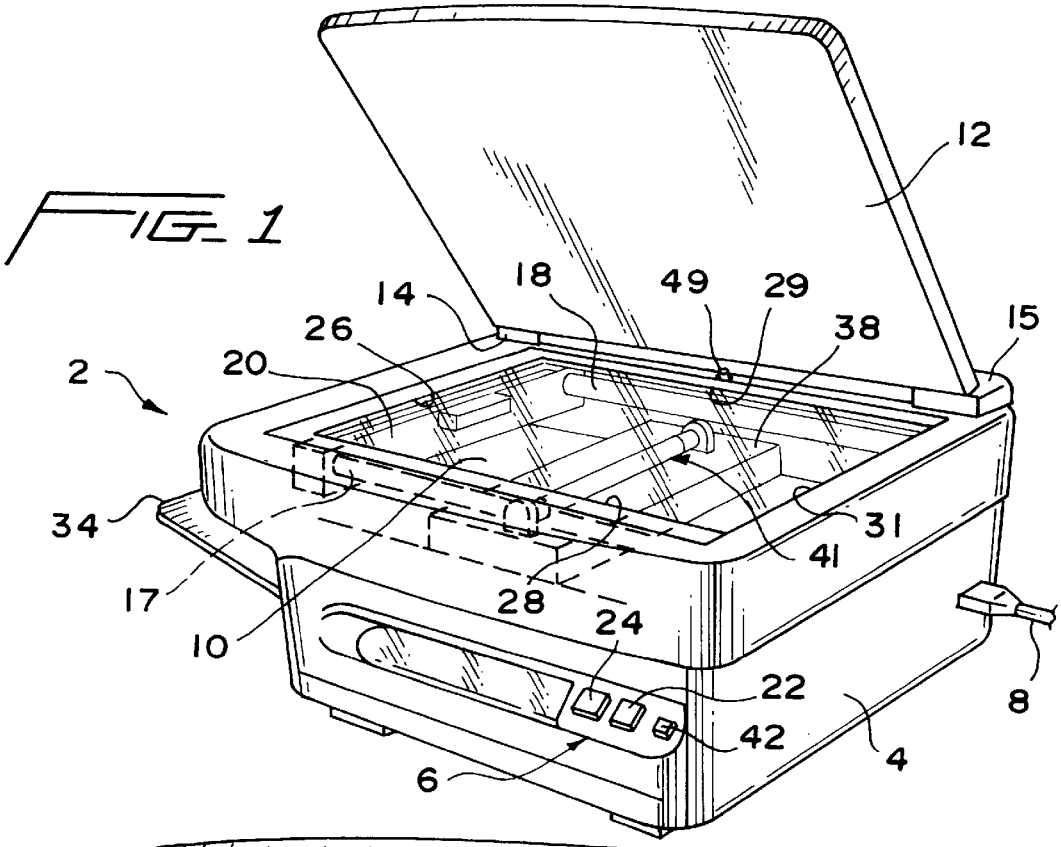
FIG. 1 is a perspective view of a copy machine, incorporating the document previewing system of the present invention, with a document cover of the machine being shown in an open condition.
Figure 2:
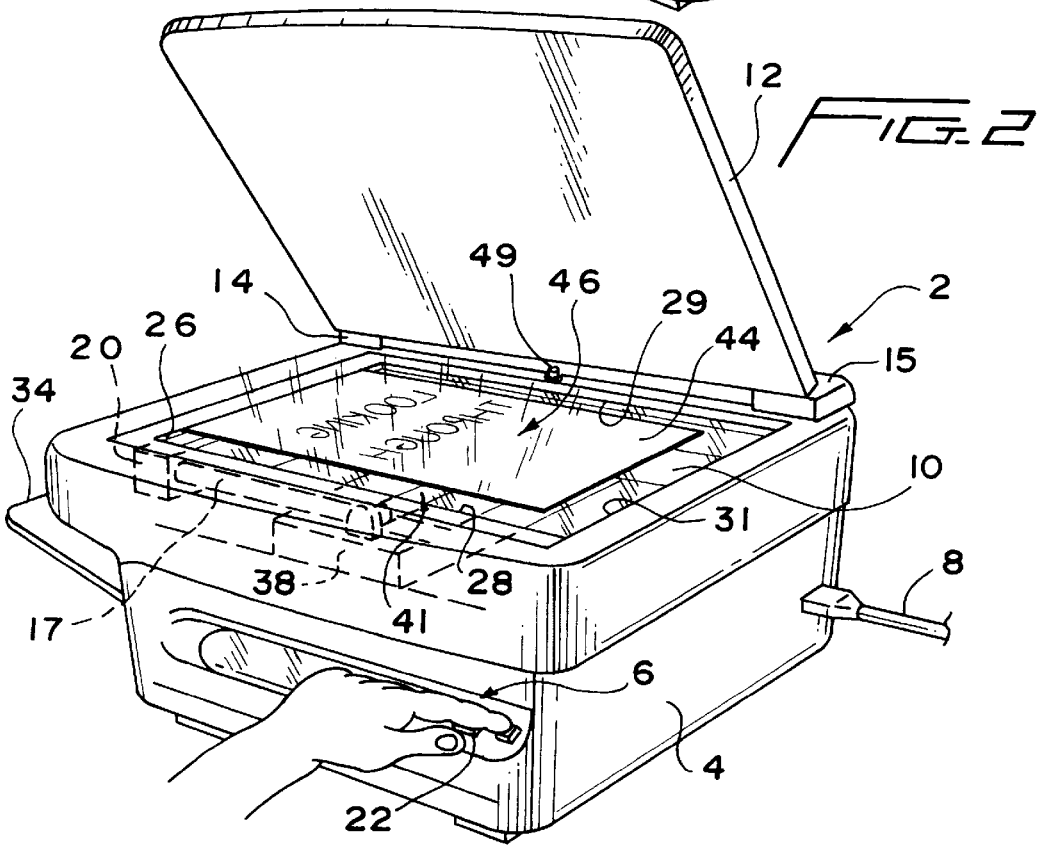
FIG. 2 is a perspective view similar to that of FIG. 1 but depicting a document positioned within the copy machine and the previewing system of the invention activated.

FIGS. 1 and 2 are intended to illustrate a simple, generic type of copier machine which is generally indicated at 2. Copier machine 2 includes a base 4, a portion of which houses a control panel 6 which can be used to activate copier machine 2 once a power cord 8 is plugged in. Base 4 also supports an upper transparent plate 10 upon which documents to be copied are placed in a manner widely known in the art. Arranged above plate 10 is a lid 12 which is hinged at 14 and 15 for movement between a raised position, as shown in these figures, and a lowered position wherein lid 12 covers plate 10. As shown, mounted beneath plate 10 is a pair of spaced rails 17 and 18 which function to guide a copy bar 20 for lateral movement during a copy operation. Since the actual operation of copier machine 2 in performing a standard copy operation does not form part of the present invention and is widely known in the art, it will not be described in detail here. However, in general, a document need merely be placed on plate 10 beneath lid 12 and then, upon activation of a power button 22 and the subsequent depression of a copy button 24 provided on control panel 6, one or more copies of the document will be produced.

As clearly shown in these figures and standard on known copier machines, plate 10 includes an upper paper edge 26, side edges 28 and 29 and a rear edge 31, all of which combine to define a copy zone. Depending upon the manner in which the document is desired to be copied, a portion of the document would be generally aligned with one or more of these edges. The most typical arrangement is to align a top portion of the document with upper edge 26 and to equally space the paper from side edges 28 and 29 in performing a copying operation. For the sake of completeness, a paper catch tray 34 for collecting the copies produced by machine 2 is depicted.

In the embodiment shown, copier machine 2 is provided with an internal component cover 38. In connection with the present invention, an illumination source 41 is mounted atop cover 38 at a position spaced below rails 17 and 18 so as to not interfere with the movement of copy bar 20. Illumination source 41 can take various forms in accordance with the present invention and is preferably constituted by a white incandescent, fluorescent or optical lighting unit. Illumination source 41 is linked to a button 42 on control panel 6 such that illumination source 41 can be selectively activated by pushing button 42. This arrangement is best shown in FIG. 2 wherein a document 44 has been positioned with writing 46 of document 44 on the side of transparent plate 10 and illumination source 41 has been activated. Normally, the writing 46 would not be visible through the document 44. However, with the activation of illumination source 41, a mirror image of the writing is clearly visible. At this time, document 44 can be easily adjusted upon plate 10 such that selected portions of the written material can be arranged for copying. For instance, document 44 can be shifted beyond upper paper edge 26 such that some of the wording will not be copied or other wording can be arranged in a desired copying position. Once document 44 is appropriately arranged, lid 12 can be closed and a copy produced in the normal manner.

In further accordance with the present invention, it is desired to assure that illumination source 41 is maintained in an off condition whenever a copying operation is being performed. In the simplest form, button 42 would simply be pressed an additional time to turn illumination source 41 off. However, if the white light of illumination source 41 is to be maintained during a standard copying operation, an inferior copy would be produced. Therefore, the present invention contemplates incorporating additional structure which functions to automatically turn off illumination source 41 when a copying operation is to be performed. Although this function could be carried out in many ways, including incorporating a timing mechanism linked to button 42 or requiring button 42 to be held in the depressed condition to maintain illumination source 41 activated, it is preferable to provide structure that will automatically turn off illumination source 41 upon the closing of lid 12. Therefore, in accordance with the invention, it is preferable to provide an additional cut-off switch 49 which is activated upon the closing of lid 12. At this point, it should be realized that various switching devices could be utilized and that switch 49 could be arranged in various positions while still being controlled by the closing of lid 12. For instance, a switch could be incorporated in one of hinges 14 and 15 without departing from the invention. However, for the sake of simplicity, switch 49 is shown to be essentially mounted adjacent side edge 29, i.e., at a rear portion of copier machine 2, wherein the switch 49 will be depressed upon pivoting of lid 12 through only a small portion of its full range of travel. This arrangement assures that illumination source 41 will be de-activated well before copier button 24 is depressed. Another solution is to electrically cut off power to illumination source 41 when copy button 24 is engaged.

With the above arrangement, one or more documents can be pre-arranged upon plate 10 in a desired manner utilizing the previewing system of the present invention prior to performing a copying operation. Given that only a few components are necessary to incorporate the previewing system of the present invention into a standard copier machine, the added cost to the manufacturing of the copier machine will be quite small, while the versatility of the machine will be greatly enhanced. Certainly, incorporation of the previewing system will minimize the waste of copier paper, as well as toner and operating time. In any event, although described with reference to a preferred form of the invention, it should be readily understood that various changes and/or modifications may be made to the invention without departing from the spirit thereof. In particular, the exact positioning and arrangement of illumination source 41 can greatly vary in accordance with the invention in order to perform the function of illuminating the document placed on plate 10 from beneath so that the light produced by the illumination source will shine through the document, thereby enabling the writing, in the form of words, drawings or otherwise, on the document to be readily viewed. In addition, light guides, reflectors and/or defractors could also be incorporated without departing from the spirit of the invention.

I claim:

1. in a copier machine, a system for previewing an alignment of a document placed in a copy zone of the copier machine prior to initiating a copying operation comprising:

a lighting source for illuminating, from beneath the document, at least a portion of the document placed in the copy zone in order to permit viewing of subject matter on the document, through the document, to enable alignment of the document in the copy zone prior to the copying operation;

a panel switch for controlling an activation state of the lighting source;

a lid movable between raised and lowered positions for selectively exposing and covering the copy zone respectively; and a cut-off switch adapted to de-activate the lighting source upon closing of said lid.

2. The previewing system according to claim 1, wherein the copier machine includes a transparent plate defining the copy zone, said light source being mounted beneath said transparent plate.

3. The previewing system according to claim 2, wherein said light source is fixed beneath said transparent plate.

4. The previewing system according to claim 1, wherein the panel switch comprises a button provided on a control panel of the copier machine.

5. The previewing system according to claim 1, wherein said cut-off switch is adapted to control the de-activation state of the lighting source upon pivotal movement of said lid a minimal amount.

6. In a copier machine including a transparent plate defining a copy zone in which one or more documents is adapted to be placed for a copying operation, and a lid for selectively exposing and covering the copy zone, a system for previewing an alignment of a document placed in the copy zone prior to initiating the copying operation comprising:

a lighting source for illuminating, from beneath the document, at least a portion of the document placed in the copy zone in order to permit viewing of subject matter on the document, through the document, to enable alignment of the document in the copy zone prior to the copying operation; and a panel switch for controlling an activation state of the lighting source, wherein the lid is movable between raised and lowered positions for respectively exposing and covering the copy zone, wherein said previewing system further comprises a cut-off switch adapted to de-activate the lighting source upon closing of said lid.

7. The previewing system according to claim 6, wherein the copier machine includes a transparent plate defining the copy zone, said light source being mounted beneath said transparent plate.

8. The previewing system according to claim 7, wherein said light source is fixed beneath said transparent plate.

9. The previewing system according to claim 6, wherein the panel switch comprises a button provided on a control panel of the copier machine.

10. The previewing system according to claim 6, wherein said cut-off switch is adapted to control the de-activation state of the lighting source upon pivotal movement of said lid a minimal amount.

11. A method of previewing an alignment of a document arranged in a copy zone of a copier machine prior to initiating a copying operation comprising;

positioning a lid of the copier machine to expose the copy zone;

initially arranging a document in the copy zone;

illuminating, through the use of an activated lighting source, at least a portion of the document, from beneath the document, wherein subject matter on the portion of the document can be viewed through the document;

aligning the document in the copy zone for the copying operation;

automatically de-activating the lighting source upon initiating the copying operation; and performing the copying operation of the document as aligned.

12. The method according to claim 11, further comprising:

automatically de-activating the lighting source, upon initiating the copying operation, by shifting of the lid to cover the copy zone.

13. The method according to claim 11, further comprising: activating the lighting source by manually engaging an activation switch.

14. The method according to claim 11, further comprising: de-activating the lighting source after a set time period following activation.

15. The method according to claim 11, further comprising:

initiating the copying operation by engaging a copy button.

* * * * *